US008940225B2

(12) United States Patent
Lotz

(10) Patent No.: US 8,940,225 B2
(45) Date of Patent: Jan. 27, 2015

(54) NOZZLE FOR CUTTING STEEL WORKPIECES AND WORKPIECES MADE OF IRON ALLOYS

(75) Inventor: Horst Lotz, Hofheim-Wallau (DE)

(73) Assignee: Gesellschaft für Autogenmaschinen und -geräte mbH, Königstein (DE)

( * ) Notice: Subject to any disclaimer, the term of this patent is extended or adjusted under 35 U.S.C. 154(b) by 285 days.

(21) Appl. No.: 13/639,102

(22) PCT Filed: Feb. 25, 2010

(86) PCT No.: PCT/EP2010/052412

§ 371 (c)(1), (2), (4) Date: Oct. 3, 2012

(87) PCT Pub. No.: WO2011/103923

PCT Pub. Date: Sep. 1, 2011

(65) Prior Publication Data

US 2013/0038001 A1 Feb. 14, 2013

(51) Int. Cl.
*B23K 7/00* (2006.01)
*F23D 14/54* (2006.01)

(52) U.S. Cl.
CPC ..... *F23D 14/54* (2013.01)
USPC ..... 266/48; 266/74

(58) Field of Classification Search
CPC ..... F23D 14/54
USPC ..... 266/48, 74
See application file for complete search history.

(56) References Cited

U.S. PATENT DOCUMENTS

| | | | | |
|---|---|---|---|---|
| 3,923,448 | A | 12/1975 | Guth | |
| 4,455,176 | A | 6/1984 | Fuhrhop | |
| 5,944,915 | A | 8/1999 | Bissonnette | |
| 2013/0038001 | A1 * | 2/2013 | Lotz | 266/48 |

FOREIGN PATENT DOCUMENTS

| | | | |
|---|---|---|---|
| EP | 0097883 | A1 | 1/1984 |
| EP | 0191741 | A2 | 8/1986 |
| GB | 518494 | A | 2/1940 |
| GB | 739155 | A | 10/1955 |

* cited by examiner

*Primary Examiner* — Scott Kastler
(74) *Attorney, Agent, or Firm* — Michael Soderman

(57) ABSTRACT

A nozzle for cutting steel workpieces and workpieces made of iron alloys comprising a nozzle body with an axial hole for the outflow of cutting oxygen and a cylindrical free space at the outlet surface of the nozzle forming the cutting flame. Furthermore, the nozzle has a plurality of heating gas holes and a plurality of heating oxygen holes that are arranged in an external or internal concentric circle around the axial hole. In addition, a number of cooling oxygen holes arranged in at least one concentric circle around the axial hole are provided that run from the inlet side of the nozzle body to the outlet surface of the nozzle and open outside of the pot-shaped, cylindrical free space.

9 Claims, 3 Drawing Sheets

B-B

C-C

NOZZLE FOR CUTTING STEEL WORKPIECES AND WORKPIECES MADE OF IRON ALLOYS

CROSS REFERENCE TO RELATED APPLICATIONS

This application is the U.S. national stage of International Application No. PCT/EP2010/052412, filed on Feb. 25, 2010, and claims the benefit thereof. The international application is incorporated by reference herein in its entirety.

BACKGROUND

The invention relates to a nozzle for cutting steel workpieces and workpieces made of iron alloys, comprising a nozzle body with

- an axial hole for the cutting oxygen and a pot-shaped, cylindrical free space at the outlet surface of the nozzle forming the cutting flame,
- a plurality of heating oxygen holes and heating gas holes that are arranged in concentric circles around the axial hole, and
- a hexagon head, if necessary, for screwing the nozzle onto a cutting torch.

Oxygen-fuel gas cutting torches are intended to be used to cut steel workpieces and workpieces made of iron alloys. Blocks and slabs are effectively cut with that, for example. In so doing, the flame of the gas cutting torch ignited from a jet of oxygen and cutting gas is directed to the surface of the metal to be cut. The metal is heated to its ignition temperature because of that; a jet of cutting oxygen oxidizes the heating metal to bring about the cutting. In the process, the workpiece starts to burn and forms a gap that extends into a cut when the jet continues on. Since heat also arises while this takes place, this torch-cutting is called autogeneous, i.e. there is further preheating of the next steel layers of the area to be cut from the heat that is obtained from the burning steel.

A distinction is made in principle between premixed nozzles or postmixed nozzles or torches. In the case of premixing nozzles, heating oxygen and heating gas are mixed in the torch head before they flow out for ignition. In a postmixing cutting torch, the heating oxygen and the heating gas are discharged from the torch in an unmixed stream. The streams are mixed with one another via turbulence before ignition takes place.

So-called postmixed cutting nozzles for a cutting-torch unit in which there is an exclusive mixture of heating oxygen, heating gas and cutting oxygen at the outlet area of the flame are known from U.S. Pat. No. 6,277,323 B1 and CA 2,109,772 C. The nozzle is encompassed by a retaining nut that surrounds the nozzle and that is connected to the cutting torch. The nozzle has an axial hole for the outflow of cutting oxygen of a cutting torch. Furthermore, a plurality of heating gas holes are provided that are arranged in an internal, concentric circle around the axial hole. Moreover, the nozzle includes a plurality of heating oxygen holes that are arranged in an external concentric circle around the axial hole. Each of the holes, namely the axial hole, the heating gas holes and the heating oxygen holes, lead into outflow openings at an outflow end that transitions into a cylindrical free space in the retaining nut in which the cutting flame is formed.

This nozzle therefore involves an externally mixing—also called a "postmixing"—nozzle, i.e. there is no mixture of the gases inside the nozzle. Further, the nozzle has a multi-part design because of the additional retaining nut, so it is expensive and complicated to manufacture. On top of that, impurities such as cinder, dust and dirt particles can collect at the outlet area of the flame in the cylindrical free space in the retaining nut and penetrate into the nozzle.

SUMMARY

A nozzle (1) for cutting steel workpieces and workpieces made of iron alloys comprising a nozzle body (2) with an axial hole (5) for the outflow of cutting oxygen and a cylindrical free space (7) at the outlet surface (8) of the nozzle (1) forming the cutting flame (10).Furthermore, the nozzle (1) has a plurality of heating gas holes (13) and a plurality of heating oxygen holes (11) that are arranged in an external or internal concentric circle around the axial hole (5). In addition, a number of cooling oxygen holes (15) arranged in at least one concentric circle around the axial hole (5) are provided that run from the inlet side (6) of the nozzle body (2) to the outlet surface (8) of the nozzle (1) and open outside of the pot-shaped, cylindrical free space (7).

DETAILED DESCRIPTION

The task of the invention is to create a nozzle of the type mentioned at the outset that can be manufactured at a reasonable price, that is protected against impurities to a very great extent and that achieves a higher level of efficiency when torch-cutting workpieces made of steel and iron alloys.

The problem is solved in accordance with the invention by additionally providing a number of cooling oxygen holes arranged in at least one concentric circle around the axial hole that run from the inlet side of the nozzle body to the outlet surface of the nozzle and open outside of the pot-shaped, cylindrical free space.

The cooling oxygen holes are consequently are tilted towards the outside, away from the longitudinal axis, from the inlet side to the outlet surface of the nozzle body.

At least two cooling oxygen holes arranged around the axial hole are provided in the nozzle as per the invention; the number and the diameter of the cooling oxygen holes can be designed in various ways.

The cooling oxygen holes cool down the nozzle body while pure oxygen is draw in from the supply unit or the torch and form an air curtain at the outlet surface of the nozzle that surrounds the cutting flame like a tent. This air curtain protects the outlet surface against contamination with dirt particles that form during the flame cutting. They are blown away from the outlet surface of the nozzle by the air curtain of cooling oxygen that is discharged. The air curtain consequently prevents a clinging of the dirt particles via its cooling effect. The nozzle involves a postmixing nozzle.

In accordance with a further design form of the nozzle, the heating oxygen holes are tilted at an angle of at least 1° with reference to the longitudinal axis of the nozzle body from the inlet side to the outlet surface of the nozzle body. Flame blow-off and flame interruptions ("flickering") are also avoided because of that. In addition, impurities such as dust and dirt particles are not able to penetrate into the nozzle due to the rotating air curtain.

Furthermore, there are provisions, as a design feature, for the heating oxygen holes to be tilted towards the outside away from the longitudinal axis at an angle of at least 1° with reference to the longitudinal axis of the nozzle body from the inlet side to the outlet surface of the nozzle body.

With an alternative design feature, the heating oxygen holes are tilted inward towards the longitudinal axis at an angle of at least 1° with reference to the longitudinal axis of the nozzle body from the inlet side to the outlet surface of the nozzle body.

Moreover, there are provisions for a ring groove for the heating oxygen holes and/or a ring groove for the heating gas holes to be designed into the base surface of the pot-shaped, cylindrical free space.

Because of the ring groove as per the invention for the heating oxygen holes and/or the ring groove for the heating gas holes in the base surface of the pot-shaped, cylindrical free space of the nozzle body, the heating oxygen is no longer discharged against the cylindrical wall of the pot-shaped, cylindrical free space on the outlet side. A better mixture of heating oxygen and heating gas arises because of that. The heating oxygen is made to rotate in the process, i.e. it gets angular momentum; an air curtain or protective air jacket of heating oxygen forms that surrounds the cutting flame. The heating oxygen is consequently wound around the cutting flame, so to speak.

According to a further design form, the nozzle body has a one-piece design. The nozzle can be manufactured with fewer components and consequently in a more economical fashion because of that.

In a different design form of the nozzle, the outlet surface and the pot-shaped, cylindrical free space are directly defined and demarcated by the hexagon head. A situation is prevented because of that in which cinders are deposited and baked in during the use of the nozzle in the cutting process on an otherwise existing raised ring collar extending from the hexagon head to the outlet surface. The fact that the overall length of the nozzle or nozzle body is shortened is an advantage here. The pot-shaped, cylindrical free space and the cooling oxygen holes are likewise shortened here, so fewer drilling work is necessary in the nozzle body and, moreover, material is saved and weight is reduced.

BRIEF DESCRIPTION OF THE DRAWINGS

The idea underlying the invention is specified in more detail in the following description with the aid of examples that are shown in the drawings. The following views are shown.

Functionally equivalent components have been given the same reference numeral in all of the figures.

DETAILED DESCRIPTION OF THE PREFERRED EMBODIMENT

The nozzle 1 in accordance with FIGS. 1 to 6 has a nozzle body 2 with a one-piece design. The nozzle body 2 is provided with a hexagon head 3 in part around the circumference to attach it to a suitable tool on a cutting torch that is not shown. A different section of the outer circumference of the nozzle body 2 is provided with an external thread 4 to screw the nozzle 1 onto a cutting torch.

Figure 2:
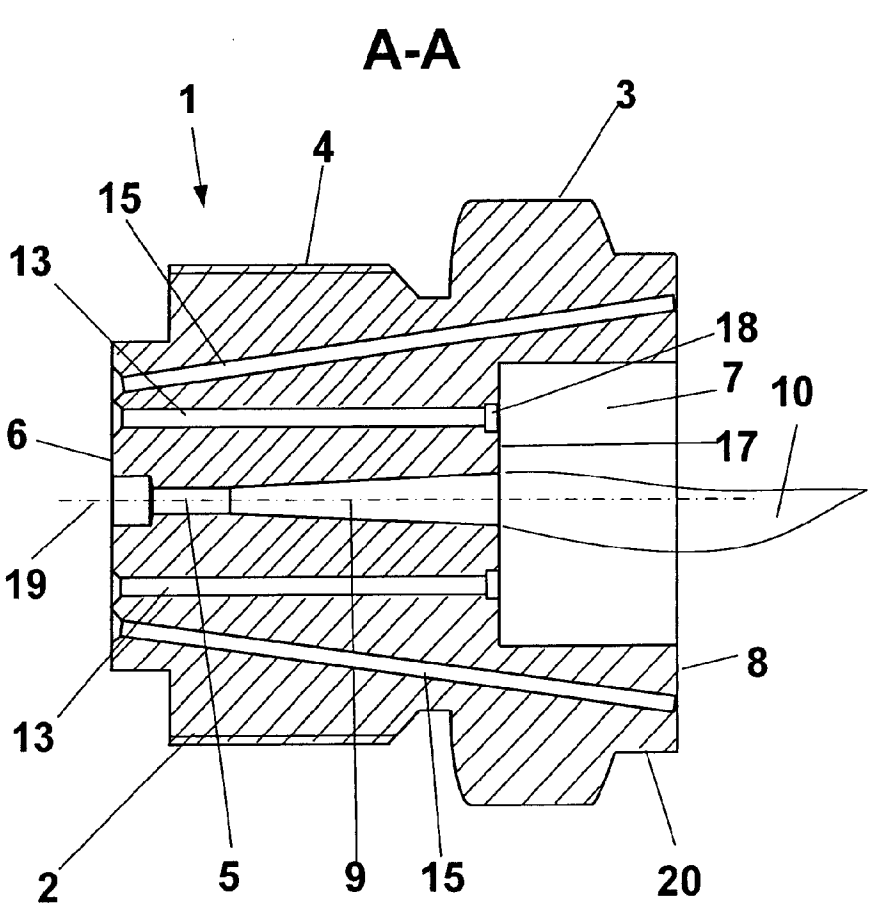
FIG. 2 shows a side view of the nozzle along the line A-A in accordance with FIG. 1.
Figure 1:
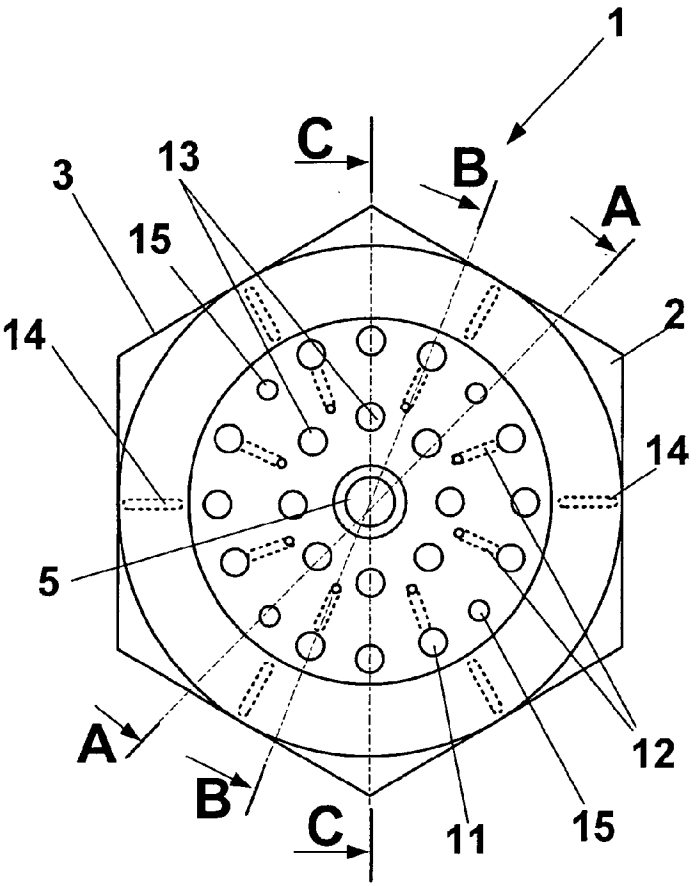
FIG. 1 shows a frontal view on the inlet side of the nozzle as per the invention in a first embodiment.

An axial hole 5 that extends from the inlet side 6 to a pot-shaped, cylindrical free space 7 at the outlet surface 8 of the nozzle body 2 is formed at the center of the nozzle body 2. In its end area that is directed towards the pot-shaped, cylindrical free space 7, the axial hole 5 has a conical extension 9; the cutting oxygen flowing through the axial hole 5 is accelerated in terms of velocity and therefore in terms of its energy because of it. The cutting flame 10 forms at this end of the axial hole 5, as shown in FIG. 2.

The nozzle 1 includes a plurality of heating oxygen holes 11 that extend with an orientation vis-a-vis the axial hole 5 that is not entirely parallel from the inlet side 6 of the nozzle 1 to the pot-shaped, cylindrical free space 7 of the nozzle body 2.

A group of several, concentrically arranged, slanted holes 12 are provided at the inlet side 6 of the nozzle 1 that lead in each case from the inlet side 6 into one of the heating oxygen holes 11 in the nozzle body 2 at an angle of around 45° with reference to the axial hole 5. Heating gas is additionally fed into the heating oxygen holes 11 through the slanted holes 12 because of the suction effect of the heating oxygen. In the process, there is a mixture of the heating oxygen with the additional heating gas in the interior of the nozzle 1.

Furthermore, a plurality of heating gas holes 13 that are arranged in an internal concentric ring of the nozzle 1 are parallel to the axial hole 5. A group of slanted holes 14 that run from the exterior surface of the nozzle body 2 to the cylindrical free space 7 of the nozzle 1 and open in it close to the outlet surface 8 of the nozzle 1 is also provided here. External atmospheric air is additionally sucked in as a result because of the suction effect of the cutting flame 10, and it surrounds the cutting flame 10 with an air curtain and simultaneously mixes with the cutting oxygen from the axial hole 5 and the heating oxygen premixed with the heating gas.

Heating gas is already additionally sucked in via the suction effect in the holes 11 for the heating oxygen and mixed with the heating oxygen because of the slanted holes 12 of the first group at the inlet side of the nozzle 1, in order to improve the efficiency of the cutting flame 10.

Furthermore, external atmospheric air is sucked into the pot-shaped, cylindrical free space 7 at the outlet surface 8 of the nozzle 1 through the slanted holes 14 of the second group as a result of the low pressure and the suction effect associated with it, and this forms an air curtain surrounding the cutting flame 10 in this area, which increases the efficiency of the cutting flame 10.

It is to be emphasized, however, that the groups of slanted holes 12 and 14 do not absolutely have to exist. They can therefore also be left out in a further design form of the examples shown below.

Moreover, a number of cooling oxygen holes 15 arranged in at least one concentric circle around the axial hole 5 are additionally provided. They run from the inlet side 6 of the nozzle body 2 to the outlet surface 8 of the nozzle 1 and open outside of the pot-shaped, cylindrical free space 7. The cooling oxygen holes 15 from the inlet side 6 to the outlet surface 8 of the nozzle body 2 are consequently tilted towards the outside.

As shown in FIGS. 2 to 5, a ring groove 16 for the heating oxygen holes 11 is formed in the base surface 17 of the pot-shaped, cylindrical free space 7. In the same way, a further ring groove 18 for all of the heating gas holes 13 is accordingly provided in the base surface 16 of the pot-shaped, cylindrical free space 7.

Figure 3:
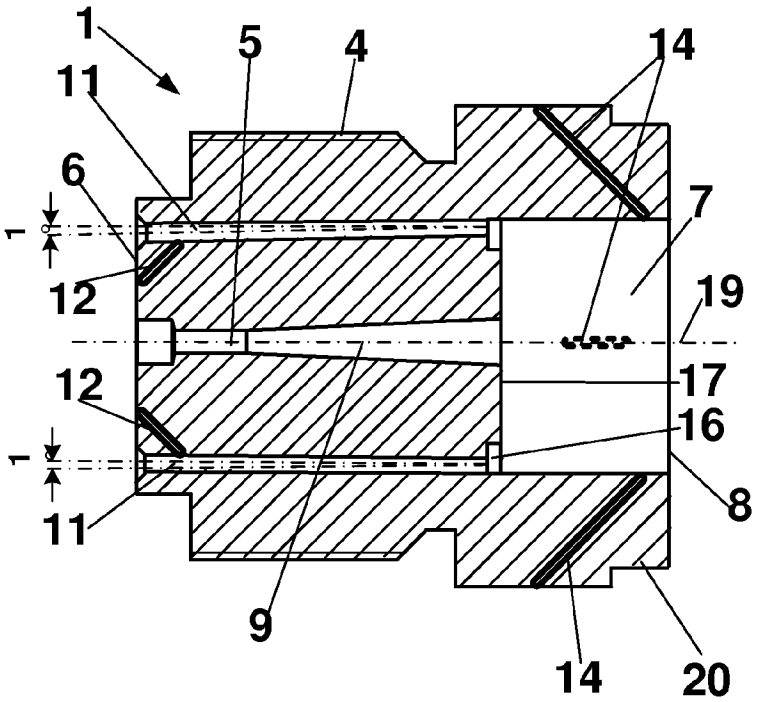
FIG. 3 shows a side view of the nozzle along the line B-B in accordance with FIG. 1.

Furthermore, as shown in FIG. 3, the heating oxygen holes 11 are tilted at an angle of at least 1°—with reference to the longitudinal axis 19 of the nozzle body 2—from the inlet side 6 to the outlet surface 8 of the nozzle body 2. The heating oxygen holes 11 are tilted towards the outside away from the longitudinal axis 19 of the nozzle body 2 from the inlet side 6 to the outlet surface 8 of the nozzle body in the embodiment that is shown.

Figure 4:
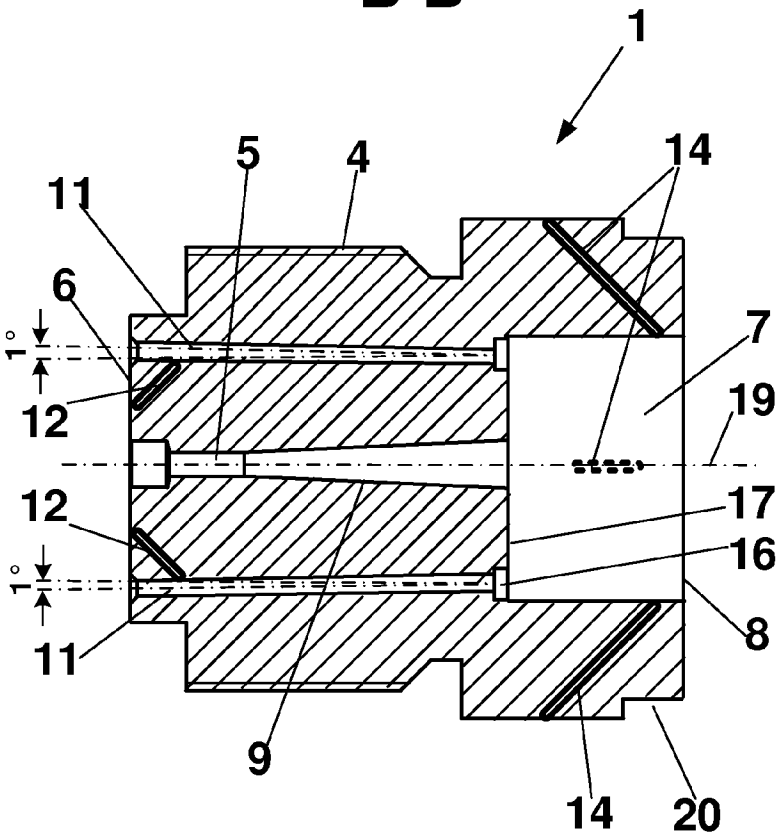
FIG. 4 shows a side view of the nozzle along the line B-B in accordance with FIG. 1 in an alternative embodiment in accordance with FIG. 3.

In the embodiment shown in FIG. 4, the heating oxygen holes 11 are instead tilted inwards towards the longitudinal axis 19 at an angle of at least 1° from the inlet side 6 to the outlet surface 8 of the nozzle body 2.

FIGS. 1 to 5 show the nozzle body 2 of the nozzle 1 with a raised ring groove part 20 formed in the outlet end at the hexagon head 3 and tapered vis-a-vis the head that partially forms the wall of the pot-shaped, cylindrical free space 7.

Figure 6:
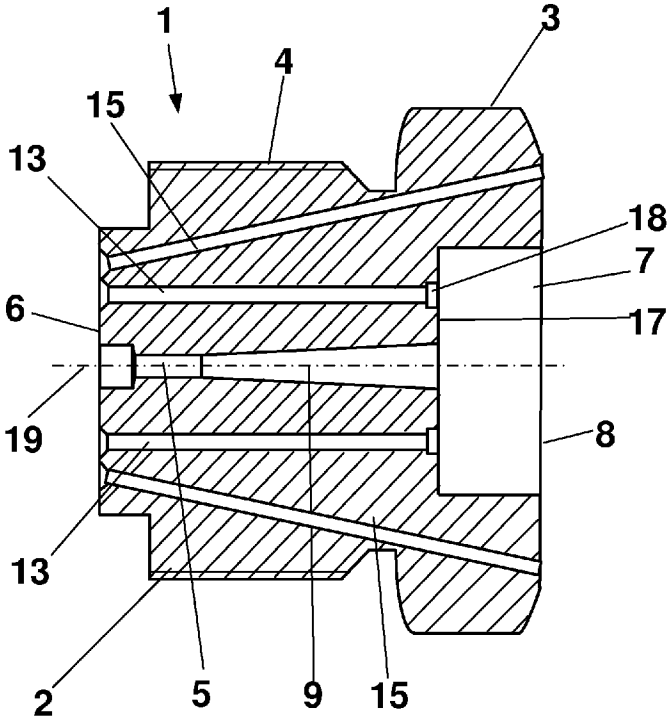
FIG. 6 shows a side view of the nozzle in a second embodiment.
Figure 5:
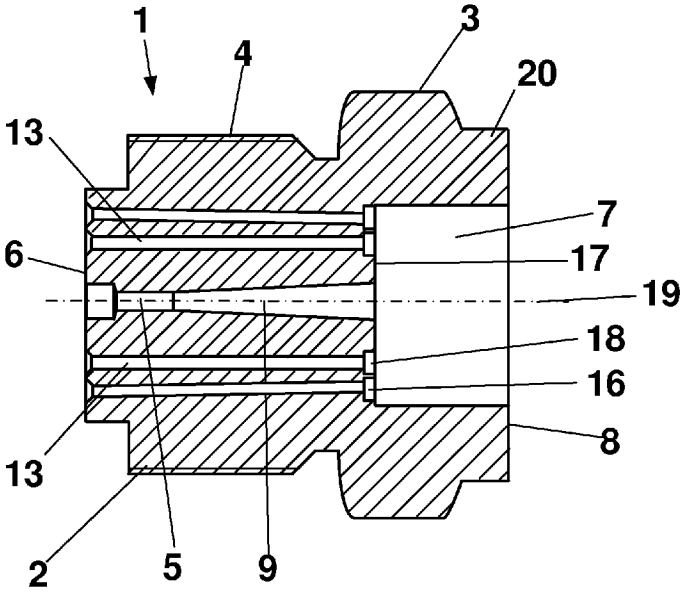
FIG. 5 shows a side view of the nozzle along the line C-C in accordance with FIG. 1.

The raised ring groove part does not exist in the embodiment in FIG. 6, so the hexagon head 3 directly defines and demarcates the outlet surface 8 of the nozzle 1. The pot-shaped, cylindrical free space 7 is less deep and the overall length of the nozzle 1 is shortened there. It is also possible in the process to increase the angle of tilt of the cooling oxygen holes 15 so that they open up further outwards, with reference to the longitudinal axis 19, on the outlet surface 8.

LIST OF REFERENCE NUMERALS

1 Nozzle
2 Nozzle body
3 Hexagon head
4 External thread
5 Axial hole
6 Inlet side
7 Free space
8 Outlet surface
9 Conical extension
10 Cutting flame
11 Heating oxygen holes
12 Slanted holes
13 Heating gas holes
14 Slanted holes
15 Cooling oxygen holes
16 Ring groove
17 Base surface
18 Ring groove
19 Longitudinal axis
20 Raised ring groove part

The invention claimed is:

1. Nozzle (1) for cutting steel workpieces and workpieces made of iron alloys comprising a nozzle body (2) with an axial hole for the cutting oxygen (5) and a pot-shaped, cylindrical free space (7) at the outlet surface (8) of the nozzle (1) forming the cutting flame (10), and a plurality of heating oxygen holes (11) and heating gas holes (13) that are arranged in concentric circles around the axial hole (5), characterized in that a number of cooling oxygen holes (15) arranged in at least one concentric circle around the axial hole (5) are additionally provided that run from the inlet side (6) of the nozzle body (2) to the outlet surface (8) of the nozzle (1) and open outside of the pot-shaped, cylindrical free space (7), and that a number of slanted holes (12) are provided that are tilted outwards away from the longitudinal axis (19) of the nozzle (1) and connect the heating gas supply with the heating oxygen holes (11), and that a number of slanted holes (14) are provided that are tilted inwards towards the longitudinal axis (19) of the nozzle (1) and connect the outside with the inside of the pot-shaped, cylindrical free space (7).

2. Nozzle according to claim 1, characterized in that at least two cooling oxygen holes (15) are provided that are arranged around the axial hole (5).

3. Nozzle according to claim 1, characterized in that the cooling oxygen holes (15) are tilted outwards away from the longitudinal axis (19) from the inlet side (6) to the outlet surface (8) of the nozzle body (2).

4. Nozzle according to claim 1, characterized in that the heating oxygen holes (11) are tilted at an angle of at least 1° with reference to the longitudinal axis (19) of the nozzle body (2) from the inlet side (6) to the outlet surface (8) of the nozzle body (2).

5. Nozzle according to claim 4, characterized in that the heating oxygen holes (11) are tilted outwardly away from the longitudinal axis (19) at an angle of at least 1° with reference to the longitudinal axis (19) of the nozzle body (2) from the inlet side (6) to the outlet surface (8) of the nozzle body (2).

6. Nozzle according to claim 4, characterized in that the heating oxygen holes are tilted inwardly towards the longitudinal axis (19) at an angle of at least 1° with reference to the longitudinal axis (19) of the nozzle body (2) from the inlet side (6) to the outlet surface (8) of the nozzle body (2).

7. Nozzle according to claim 1, characterized in that a ring groove (16) for the heating oxygen holes (11) and/or a ring groove (18) for the heating gas holes (13) is formed in the base surface (17) of the pot-shaped, cylindrical free space (7).

8. Nozzle according to claim 1, characterized in that the nozzle body (2) has a one-piece design.

9. Nozzle according to claim 1, characterized in that the outlet surface (8) and the pot-shaped, cylindrical free space (7) are directly defined and demarcated by a hexagon head (3).

* * * * *